US011131001B2

(12) United States Patent
Eckertsberger et al.

(10) Patent No.: US 11,131,001 B2
(45) Date of Patent: Sep. 28, 2021

(54) OVEN DEVICE FOR HEAT-TREATING A METAL BLANK

(71) Applicant: EBNER INDUSTRIEOFENBAU GMBH, Leonding (AT)

(72) Inventors: Gerald Eckertsberger, Wilhering (AT); Thomas Fuchs, Wallsee (AT); Fritz Josef Ebner, Wilhering (AT); Heribert Lochner, Leonding (AT); Robert Ebner, Leonding (AT)

(73) Assignee: Ebner Industrieofenbau GMBH, Leonding (AT)

( * ) Notice: Subject to any disclaimer, the term of this patent is extended or adjusted under 35 U.S.C. 154(b) by 373 days.

(21) Appl. No.: 15/752,100

(22) PCT Filed: Aug. 12, 2016

(86) PCT No.: PCT/EP2016/069265
§ 371 (c)(1),
(2) Date: Feb. 12, 2018

(87) PCT Pub. No.: WO2017/025632
PCT Pub. Date: Feb. 16, 2017

(65) Prior Publication Data

US 2018/0237871 A1 Aug. 23, 2018

(30) Foreign Application Priority Data

Aug. 13, 2015 (DE) ..... 10 2015 113 407.1

(51) Int. Cl.
*C21D 1/62* (2006.01)
*F27D 15/02* (2006.01)
(Continued)

(52) U.S. Cl.
CPC ..... *C21D 1/34* (2013.01); *C21D 1/62* (2013.01); *F27D 9/00* (2013.01); *F27D 15/02* (2013.01); *F27D 99/0001* (2013.01)

(58) Field of Classification Search
CPC .. F27D 2003/0063; F27D 15/00; F27D 15/02; C21D 9/0006; C21D 9/0056; C21D 9/006
(Continued)

(56) References Cited

U.S. PATENT DOCUMENTS 2,561,583 A * 7/1951 Marvin ..... B22F 3/16 419/28
4,573,667 A * 3/1986 Westeren ..... C21D 1/673 266/114
(Continued)

FOREIGN PATENT DOCUMENTS

CN 101743331 A 6/2010
CN 104087725 A 10/2014
(Continued)

OTHER PUBLICATIONS

International Search Report and Written Opinion for International Application No. PCT/EP2016/069265, dated Oct. 21, 2016, incl. partial English translation 16pp.
(Continued)

*Primary Examiner* — Scott R Kastler
(74) *Attorney, Agent, or Firm* — Lewis Roca Rothgerber Christie LLP

(57) ABSTRACT

The present invention relates to an oven device for heat-treating a blank. The oven device has an oven housing having an oven chamber, in which the blank can be heat-treated with a defined temperature, and a tempering body, which is arranged in the oven chamber. Furthermore, the oven device has a tempering body and a tempering device. The tempering device is arranged within the oven chamber
(Continued)

Figure 1:
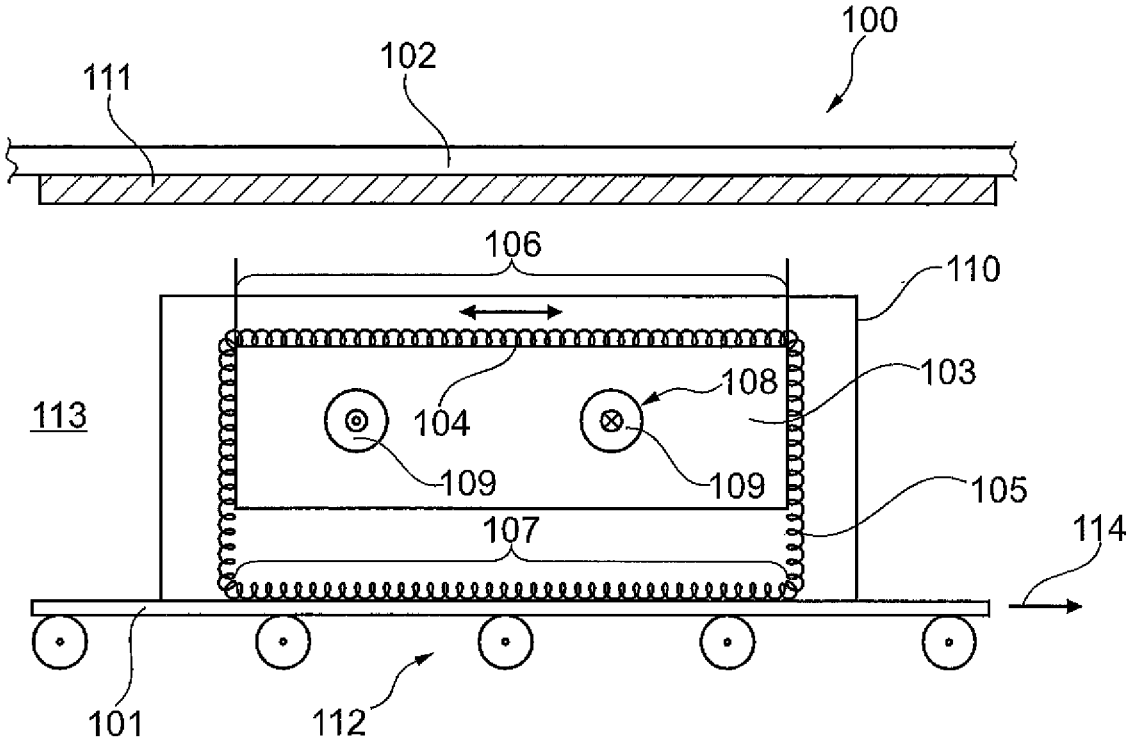

movably between a first position and a second position, such that the tempering device is, at least in the first position, in thermal contact with the tempering body and can, in the second position, be brought in thermal contact with the blank.

17 Claims, 3 Drawing Sheets

(51) Int. Cl.
*C21D 1/34* (2006.01)
*F27D 9/00* (2006.01)
*F27D 99/00* (2010.01)

(58) Field of Classification Search
USPC ..... 266/260
See application file for complete search history.

(56) References Cited

U.S. PATENT DOCUMENTS

| | | | | |
|---|---|---|---|---|
| 5,435,378 | A * | 7/1995 | Heine | B23K 3/047 165/168 |
| 10,099,870 | B2 | 10/2018 | Ebner et al. | |
| 2010/0186940 | A1 | 7/2010 | Raick | |
| 2013/0068756 | A1 | 3/2013 | Doerr et al. | |
| 2015/0053670 | A1 | 2/2015 | Horn et al. | |
| 2015/0225189 | A1 | 8/2015 | Ebner et al. | |
| 2016/0059295 | A1* | 3/2016 | Frost | B21D 22/022 72/354.6 |
| 2020/0370833 | A1* | 11/2020 | Ebner | C21D 8/0294 |

FOREIGN PATENT DOCUMENTS

| | | | |
|---|---|---|---|
| CN | 104736729 | A | 6/2015 |
| DE | 42 18 153 | A1 | 12/1992 |
| DE | 10 2012 216 468 | B3 | 1/2014 |
| DE | 10 2012 111 271 | A1 | 5/2014 |
| DE | 10 2014 201 259 | A1 | 7/2015 |
| DE | 10 2015 215 179 | A1 | 2/2017 |
| EP | 2 182 081 | A1 | 5/2010 |
| EP | 2 423 337 | A2 | 2/2012 |
| EP | 2 570 204 | A2 | 3/2013 |
| EP | 2 840 153 | A2 | 2/2015 |
| WO | 2015110456 | A1 | 7/2015 |

OTHER PUBLICATIONS

Office action issued in parallel Chinese Patent Application No. 201680059353.6, dated Jan. 28, 2019, 7 pages.

* cited by examiner

OVEN DEVICE FOR HEAT-TREATING A METAL BLANK

CROSS-REFERENCE TO RELATED APPLICATIONS

The present application is a national phase application derived from International Patent Application No. PCT/EP2016/069265, filed Aug. 12, 2016, and claims the benefit of the priority date of German Patent Application No. DE 10 2015 113 407.1, filed Aug. 13, 2015, both of which being incorporated herein by reference in their entirety.

TECHNICAL AREA

The present invention relates to an oven device for heat-treating a metal blank and a method for heat-treating a metal blank.

BACKGROUND OF THE INVENTION

In the frame-and-body construction for motorcars, construction parts are preferred, which have a low weight both at a desired stability and a desired deformation behavior at the same time. In areas of the autobody, which are exposed to particular high loads in the case of a crash, press-hardened component parts are used, which are produced from high-strength steels and have differently ductile zones. As examples for such component parts, the A-column and the B-column, the bumper bar, and the door impact supports of a motorcar can be named.

Component parts having differently ductile zones are manufactured for example by metal blanks having zones, which are heat-treated differently. This different heat treatment of different zones of the metal blanks is controlled for example by a selective setting of different temperature profiles and/or cooling profiles.

DE 10 2012 216 468 discloses for example the manufacture of a metal component part, in which different zones of the metal component part are cooled down with different cooling profiles and/or cooling speeds, such that the two zones have different ductile properties.

STATEMENT OF THE INVENTION

There may be a need to provide an oven device, which enables a flexible and efficient heat-treatment of a metal blank.

This need may be satisfied by an oven device for heat-treating a metal blank and by a method for heat-treating a metal blank according to the independent patent claims.

According to an exemplary embodiment of the invention, there is provided an oven device for heat-treating a blank (e.g. a metal blank). The oven device has an oven housing having an oven chamber, in which the blank is heat-treatable (or can be heat-treated) with a defined temperature. The oven device further has a tempering body (or temperature control body), which is arranged in the oven chamber. The oven device further has a tempering device (or temperature control device), wherein the tempering device is arranged within the oven chamber movably between a first position and a second position, such that the tempering device is, at least in the first position, in thermal contact with the tempering body, and can, in the second position, be brought in thermal contact with the blank.

In an exemplary embodiment of the invention, the tempering device may be formed as a belt element and/or with a plurality of tempering pins. Both implementations are explained in the following in more detail.

In an exemplary embodiment of the invention, the belt element may have a first section. The tempering body may have a tempering surface, wherein the belt element may be arranged within the oven chamber movably between the first position and the second position, such that the first section may be, in the first position, in thermal contact with the tempering surface, and such that the first section can, in the second position, be brought in thermal contact with the blank.

In the exemplary embodiment having a plurality of tempering pins, the tempering body correspondingly may have a plurality of receiving boreholes, into each of which one of the tempering pins can be introduced, respectively. The plurality of tempering pins may be arranged movably between the first position and a second position, such that the plurality of tempering pins may be, in the first position, present in thermal contact with the tempering body, and can, in the second position, be brought in thermal contact with the blank.

According to a further exemplary embodiment of the invention, there is described a method for heat-treating a blank. According to the method, the blank is provided in an oven chamber of an oven housing of an oven device, in which the blank is heat-treated with a defined temperature. A belt element is moved within the oven chamber between a first position and a second position, wherein, in the first position, a first section (of the belt element) is in the thermal contact with a tempering surface of a tempering body, which is arranged in the oven chamber, and, in the second position, the first section is in thermal contact with the blank.

The blank may describe a metal workpiece and/or a semi-finished product, from which a component part is manufactured with a desired shape and ductility. The blank may be, for example, a sheet metal having a thickness of less than approximately 2 cm, in particular less than approximately 1 cm. By the metal component part, for example a metal device, such as e.g. a motorcar component, can be manufactured. For example, the motorcar component can represent an A-column or a B-column of a motorcar, a bumper bar or a door impact carrier of a motorcar.

DETAILED DESCRIPTION OF EXEMPLARY EMBODIMENTS

In an exemplary embodiment of the invention, the blank may consist of a steel, which has, besides iron, impurities conditional of manufacturing. The metal component may further have alloy components, such as for example (in weight %) C: 0.02-0.6%, Mn: 0.5-2.0%, Al: 0.01-0.06%, Si: 0.1% up to 0.4%, Cr: 0% up to 1.2%, P: 0 up to 0.035%, S: 0 up to 0.035%. The metal component part may further have one or more elements out of the group, which consists of: Ti, B, Mo, Ni, Cu and/or N, wherein Ti in a percentage of 0 up to 0.05%, Cu in a percentage of 0 up to 0.01%, B in percentages from 0.0008 up to 0.005%, Mo in percentages from 0 up to 0.4%, Ni in percentages from 0 up to 0.4%, N in percentages from 0 up to 0.01% can be contained.

In an exemplary embodiment of the invention, the oven device may be formed for heating up the blank. The blank may be heated up or cooled down in the oven device to a desired temperature, e.g. to the austenitizing temperature. The austenitizing temperature may amount, for example, to approximately 750° C. up to approximately 1000° C., wherein the lower boundary of the austenitizing temperature may depend on the material of the metal component part (steel and alloy percentages). Above the austenitizing temperature, a complete austenitic microstructure may be present in the metal component part.

In an exemplary embodiment of the invention, the oven device may have the oven chamber or a plurality of different oven chambers. For example, a defined temperature can be adjusted in each oven chamber, such that the blank may be exposed to a defined temperature for heating or for cooling down in each of the oven chambers. The oven device may be configured in particular such that a predetermined, temporally changeable temperature profile can be adjusted in the oven chamber. The temperature profile may act on (or affects) the blank, while the latter may be located in the oven chamber of the oven housing of the oven device. For example, the oven device may be configured such that the blank is non-portable during the whole temperature process stationary in the oven housing, and thus may be present in one and the same oven chamber. Alternatively, the oven device may be configured for example according to the type of a continuous furnace (or through-type furnace), such that the blank may be transported (or conveyed) by a conveying device sequentially or continuously through the oven chamber and/or through plural oven chambers that may be arranged one after another along the conveying direction.

In an exemplary embodiment of the invention, a pre-defined, temporally changeable temperature profile (e.g. heating and/or cooling profile) may describe a spatial and/or temporal temperature sequence of a temperature, which may be adjustable in a defined oven chamber and which may act on the whole blank and/or on pre-defined regions of the blank. Thus, the blank may be heated, for example, in the oven device in a first oven chamber to a pre-defined temperature, and at another point in time and/or in a further, second oven chamber another temperature, which may act on the blank and may cool or may further heat the latter, may be adjusted.

For the purpose of this exemplary embodiment of the invention, for example, heating elements or cooling elements can be arranged in the oven chamber in order to possibly adjust a desired temperature profile in the oven chamber, such that the blank may be selectively heated, cooled or kept at a same temperature. The temperature in the oven chamber of the oven device may be adjusted, for example, between approximately 100° C. up to approximately 1000° C.

In an exemplary embodiment of the invention, in order to adjust selectively different ductile regions of a blank, defined regions of the blank may be selectively heated differently in time, and in particular cooled down differently in time, in order to thereby possibly adjust different microstructure regions in the different regions of the blank. In particular for a heating up of the metal component part, the heating speed may amount from approximately 1 K/s up to approximately 20 K/s. By the tempering (or temperature controlling) of the oven chamber, and in particular by the tempering of the belt element that is described in detail further below, regions of the metal component part may, for example, also be cooled down, i.e. such that cooling speeds from approximately 1 K/s up to approximately 40 K/s can be achieved.

In an exemplary embodiment of the invention, that microstructure, which adjusts itself in the blank during the heating, the keeping at a temperature or the cooling, can be taken from a time-temperature-transformation (ZTU, German: Zeit-Temperatur-Umwandlung) diagram). In a ZTU diagram, the microstructure development for different temperature sequences and/or cooling speeds during the cooling can be read out.

In an exemplary embodiment, by the present invention, in particular, pre-defined regions of the blank may be cooled down slowly or quickly by bringing a first section of the belt element and/or the tempering pins in thermal contact with a pre-defined surface region of the blank, which region is to be cooled down. Alternatively, in particular, pre-defined regions of the blank can be heated up quickly by bringing a first section of the belt element and/or the tempering pins in thermal contact with a pre-defined surface region of the blank, which region is to be heated up quickly.

In the following, the expression "thermal contact" may be understood to be a thermal interaction between two different elements, e.g. the first section of the belt element and/or the tempering pins on the one hand and the blank on the other hand, such that a quick temperature exchange between the corresponding two elements is enabled. Such a quick temperature exchange between the corresponding two elements (e.g. the corresponding section of the belt element and/or the tempering pins on the one hand and the blank on the other hand) may be effected in particular by the first element, e.g. the corresponding section of the belt element and/or the tempering pins, being present in physical contact with the second element, e.g. the desired region of the blank. This may mean for example that the corresponding section of the belt element and/or the tempering pins touch the desired region of the blank, such that thermal energy can be exchanged quickly between both elements. This may lead to a cooling or a heating of the desired region of the blank.

Alternatively, thermal contact may be understood such that between two elements, e.g. the corresponding section of the belt element and/or the tempering pins on the one hand and the corresponding region of the blank on the other hand, a small distance may be present, i.e. a distance between approximately 1 millimeter and approximately 2 centimeters.

In an exemplary embodiment of the invention, the tempering body may have, in particular, a high heat storage capacity, such that it can perform plural cooling cycles of the first section of the belt element and/or of the tempering pins. As is described below in detail with respect to different exemplary embodiments, the tempering body can be arranged exchangeably in the oven chamber and/or may be provided with a cooling or heating device (i.e. a tempering device). The tempering body may be, for example, a hollow body, which is filled with a cooling medium. The cooling medium may be, for example, a liquid medium, such as for example water or other suitable liquids. The walls of the tempering body may consist of a material having a high heat conductivity, such as for example a metallic material.

In an exemplary embodiment of the invention, the belt element may consist of a flexible and/or deformable material, and may be arranged movably between the first position and the second position by a drive device. The belt element may be formed, for example, of a metal sheet-type belt. Furthermore, the belt element may consist of a ring webbing, in particular of a metallic ring webbing.

In an exemplary embodiment of the invention, the possibility for a quick cooling down or heating up of the blank or of a defined region of the blank may be achieved according to the present invention through the operation (or use) of a pre-cooled and/or heated section of the belt element. In a preferred embodiment, in other words, the tempering body may be a cooling body, which may have a temperature that may be significantly cooler than the temperature in the oven chamber, in particular less than half of the temperature in the oven chamber.

In an exemplary embodiment of the invention, after cooling the blank, the first section of the belt element may be moved in (or to) a first position, in which the first section may be in thermal contact with a tempering surface of the tempering body. This means that in the first position, the first section may lie on the tempering surface or may have a distance from the tempering surface of less than e.g. two centimeters. In the first position, the first section of the belt element may thus be pre-cooled (and/or pre-heated) and subsequently be moved in (or to) the second position, in which the first section may be in thermal contact with the blank in order to quench (and/or to heat up) the latter. Subsequently, the first section can be moved again in (or to) the first position for a pre-cooling and/or pre-heating.

In this exemplary embodiment of the invention, thus, a defined region of the blank or the whole blank can be cooled down or alternatively heated up effectively with the first section of the belt element. At the same time, the first section can be cooled down plural times by the tempering body in order to possibly temper a plurality of blanks and/or regions of blanks without a high constructional effort or a time-costly changeover of the oven device being necessary.

In a further exemplary embodiment of the invention, the belt element may form a belt loop, which may surround the tempering body.

In an exemplary embodiment of the invention, the belt element as a band loop may run for example over one or more rollers (or rolls), wherein at least one roller (or roll) may act e.g. as a driving roller and may drive the belt element in order to possibly move the first section back and forth between the first position and the second position. The belt element as a belt loop may, for example, be arranged loosely over a driving roller or may be arranged pre-stressedly around a driving roller. The belt element may be driven, for example, according to the type of a belt drive. Thus, the belt element may have, for example, tooth elements of the type of a toothed belt, which may engage in corresponding tooth elements of a driving roller in order to thus drive the belt element. In other words, a V-belt (or fan belt) and/or a toothed belt drive (or operation) may be enabled. Alternatively, for a pre-stress of the belt element around the driving roller, a flat belt drive may be enabled.

In an exemplary embodiment of the invention, furthermore, the belt element may be formed as an open band having two free end sections, wherein a first end of the belt element may be reeled, for example, on a first driving roller and a second end that may be formed opposite to the first end may be reeled on a further, second driving roller. Accordingly, by controlling the first driving roller and the second driving roller, the belt element may be moved back and forth between the first position and the second position.

In a further exemplary embodiment of the invention, in the second position, the first section may be spaced apart from the tempering body. The belt element may be arranged such that, in the second position, the first section can be arranged between the tempering body and the blank, and the first section may be spaced apart from the tempering body.

In a still further exemplary embodiment of the invention, the belt element further may have a second section, which may be spaced apart from the first section. The second section may be formed such that, in the second position, the second section can be arranged spaced apart from the blank.

In this exemplary embodiment of the invention, in particular, in a further exemplary embodiment, the second section may be formed such that, in the second position, the second section may be in thermal contact with the tempering surface of the tempering body.

In an exemplary embodiment of the invention, by forming the second section of the belt element, the blank or plural blanks can be tempered, in particular cooled down, more effectively by the belt element. While the first section may be heated up or cooled down, for example, in the second position by a blank, the second section may be cooled down and/or heated up by the tempering body. In a subsequent production step, the belt element may be moved from the second position to the first position, such that the first section may be tempered by the tempering body and the second section may temper the blank or a further blank.

In this exemplary embodiment of the invention, accordingly, the belt element may have further, third sections, which may be arranged between the first section and the second section, and which may be, for example, in a third position of the belt element, in thermal contact either with the tempering surface of the tempering body and/or with a blank.

In this exemplary embodiment of the invention, thus, the throughput through the oven device can be increased, and thus the whole oven device can be designed more efficiently.

In a further exemplary embodiment of the invention, the belt element may be configured so that it can possibly be laid on the blank, such that upon movement of the blank, a movement of the belt element relative to the tempering body may be generatable. By laying the belt element on the blank, a friction force between the belt element and the blank may be generated. If the blank is moved along the conveying direction, the blank, during its movement, may take with it the belt element, such that the belt element may move and can, if applicable, be moved from the first position to the second and inversely. Thereby, further driving devices can be dispensed with. This embodiment may be particularly advantageous, if the belt element is formed as a belt loop, as has been explained above, such that, for one and the same movement direction of the belt element, the first section and the second section can be laid alternatingly on different regions of the blank or on blanks that may be arranged one after the other along the conveying direction.

In an exemplary embodiment of the invention, the tempering pins may consist, for example, of a highly temperature-conducting material, such as for example magnesium, copper or aluminum. The tempering pins may have, for example, a diameter from approximately 4 to approximately 15 millimeters. The tempering pins may have, for example, a length from approximately 5 to approximately 50 centimeters, in particular from approximately 10 to approximately 20 centimeters.

In an exemplary embodiment of the invention, the tempering body may consist e.g. also from a temperature-conducting material, such as for example copper. In an exemplary embodiment, the tempering pins may have, for example, a diameter of approximately 4.8 millimeters. Accordingly, the receiving boreholes may have a diameter of, for example, approximately 5 millimeters. For a better guiding of the tempering pins, the tempering body may have a thickness from approximately 20 to approximately 50 centimeters.

In a further exemplary embodiment of the invention, the tempering pins may be arranged shiftably in the respective receiving boreholes, such that, in the second position, the tempering pins can be laid on a surface of the blank and can be adjusted (or fitted) to a contour of the surface of the blank.

In an exemplary embodiment of the invention, the tempering pins may lie directly on the surface of the blank. Uprisings of the contour of the surface of the blank may shift the corresponding tempering pins in the direction towards the tempering body, and recesses in the contour of the surface of the blank may shift the corresponding tempering pins away from the tempering body. Thus, even for an uneven (or bumpy) formation of the blank, the tempering pins can lie on the surface of the blank. Thus, even for uneven blanks, a homogeneous tempering (heating up or cooling down) of the blank can be realized.

In a further exemplary embodiment of the invention, the tempering pins may be formed, for example, with a corresponding spring mechanism, such that the tempering pins can be pre-stressed with respect to a neutral position on the tempering body. An uneven (or non-planar) surface of the blank may shift the tempering pins accordingly relative to the tempering body, wherein after removing the blank, the tempering pins may be shifted to the neutral position again due to their pre-stress. The spring mechanism may, for example, have according tension springs or compression springs, which may each be assigned to one of the tempering pins respectively.

In a further exemplary embodiment of the invention, the oven device further may have a drive device. The drive device may be configured to move the tempering device between the first position and the second position. As has been explained above already, the drive device may have one or more driving rollers, which may move the belt element between the first position and the second position. Furthermore, the drive device may be a lifting device, by which the tempering pins and/or the tempering body can be moved in the direction towards the blank.

In a further exemplary embodiment of the invention, the tempering body may be arranged exchangeably in the oven chamber. Thus, the tempering body can be substituted after tempering the first section and/or the second section of the belt element, or the tempering pins, e.g. after a certain number of tempering cycles for maintenance or for their own tempering.

In this exemplary embodiment of the invention, for example, the tempering body may be formed as a passive tempering body. This means that the tempering body may have a high heat storage capacity and may not be actively tempered (or temperature-controlled) during the arrangement in the oven chamber. This means that the tempering body may heat up itself or may cool down itself after plural (cycles of) heating up and/or cooling down of the corresponding sections of the belt element and/or of the tempering pins. After a pre-defined boundary temperature of the tempering body may be reached, the latter may be substituted and may, for example, be replaced by another pre-tempered tempering body. Thus, the oven device can still temper corresponding blanks without long changeover times (or set-up times).

In a further exemplary embodiment of the invention, the tempering body may have a tempering device (or temperature control device), i.e. a cooling device or a heating device. The tempering device may temper, i.e. may cool or may heat, the tempering body, such that accordingly the particular section of the belt element and/or of the tempering pins, which may be in thermal contact with the tempering surface, may be tempered with a desired temperature. After the tempering, the corresponding section may be brought in thermal contact with the blank and may thus temper the same.

In a further preferred exemplary embodiment of the present invention, the tempering device may have a pipe, which may extend within the tempering body. The medium for tempering the tempering body can be introduced in (or fed into) the pipe (in particular from the outside of the oven housing). The medium for tempering may be in particular gaseous or liquid. For example, the medium can be a cooling medium and/or a cooling fluid for cooling the tempering body. Thus, a liquid cooling of the tempering body can be realized, such that those sections of the belt element and/or of the tempering pins, which may be in thermal contact with the tempering surface, may be cooled permanently in order to subsequently temper the blank anew.

In a further exemplary embodiment of the invention, there may be provided an insulation housing, which may be arranged in the oven chamber. The insulation housing may surround the tempering body and the belt element and/or the tempering pins at least partially, such that the insulation housing may screen thermally the tempering body and the belt element and/or the tempering pins from a region of the oven chamber, which region may surround the insulation housing. For example, the region of the oven chamber, which may surround the insulation housing, may have a high temperature, and may thus be used for heating the blank. Within the insulation housing, lower temperatures then may prevail, because the insulation housing may insulate thermally the inner space of the insulation housing from the surroundings of the insulation housing. Thus, a tempering of the blank can be performed more efficiently by the band element and/or by the tempering pins, because lower thermal influences from other regions of the oven chamber may exert a disturbing influence.

In a further exemplary embodiment of the invention, the oven device may have an insulation element (insulation block), which can be introduced selectively between the tempering body and the blank. In particular, the insulation element may, in the first position of the tempering device, be present between the tempering body and the blank. Thus, the tempering device can be brought to a desired temperature (heated up or cooled down) more efficiently by the tempering body, because the tempering body may be insulated by the insulation element from the thermal impact of the blank. The insulation element may have, in particular, good insulating properties. The insulation element may consist, for example, of ceramics and/or of ceramics composite materials. The insulation element can be introduced, for example, by a further conveying device, selectively between the tempering body and the tempering device on the one hand and the blank on the other hand.

In a further exemplary embodiment of the invention, the oven device further may have a conveying device for conveying the blank within the oven chamber. The conveying device may have, for example, a number of conveying rollers, which can be driven. A blank that may be arranged on the conveying rollers can be transported through the oven chamber along a conveying direction by rotating the conveying rollers. Alternatively, the conveying device may have a conveying belt, on which the blank may be lying. The conveying belt may be driven, such that the blank may be transported through the oven chamber in the conveying direction. In an exemplary embodiment, by the conveying device, the oven device can be formed, in particular, as a continuous furnace (or through-type furnace).

It is pointed out that embodiments of the invention have been described with reference to different subjects of the invention. In particular, some embodiments of the invention are described by device claims and other embodiments of the invention by method claims. However, it will become clear for the skilled person upon reading this application, that unless it is explicitly stated differently, in addition to a combination of features, which belong to one type of subject of the invention, also an arbitrary combination of features, which belong to different types of invention subjects, is possible.

SHORT DESCRIPTION OF THE DRAWINGS

Figure 2:
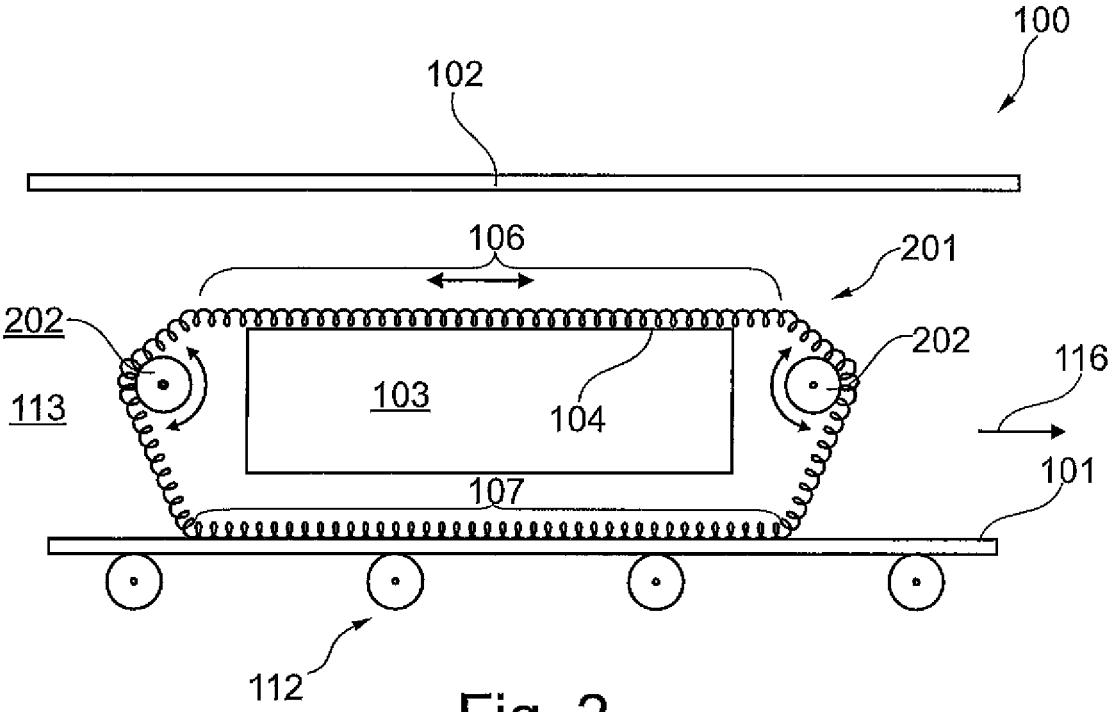
Figure 3:
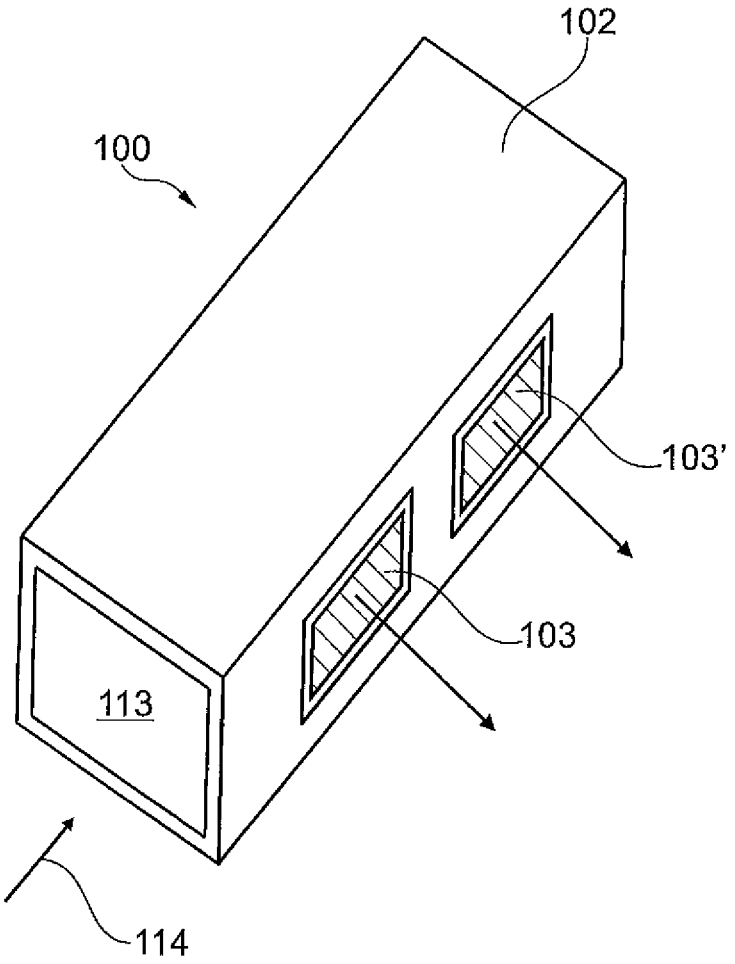
Figure 4:
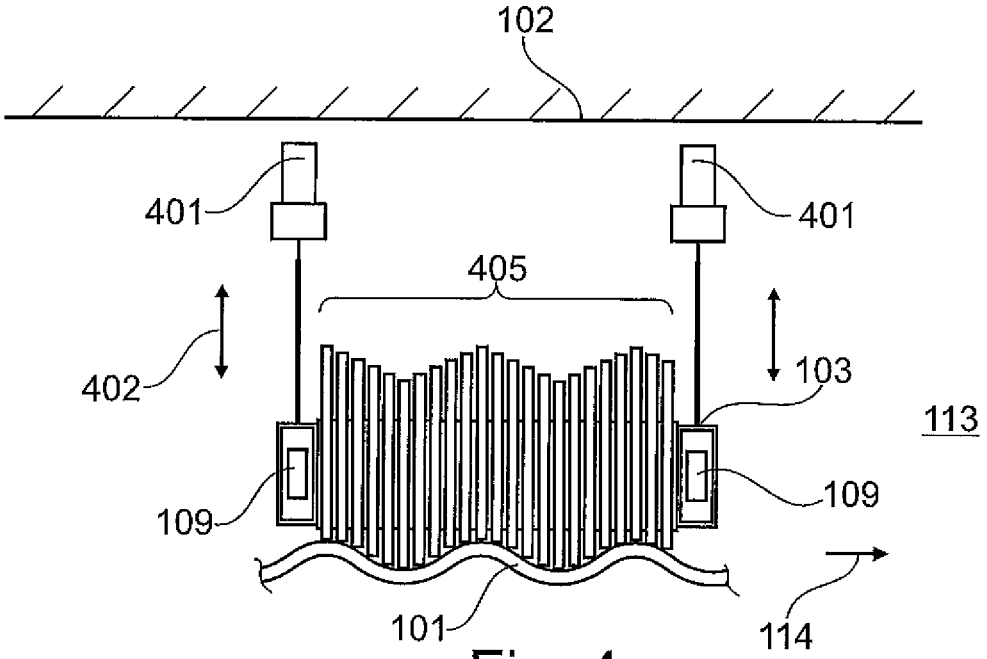
Figure 5:
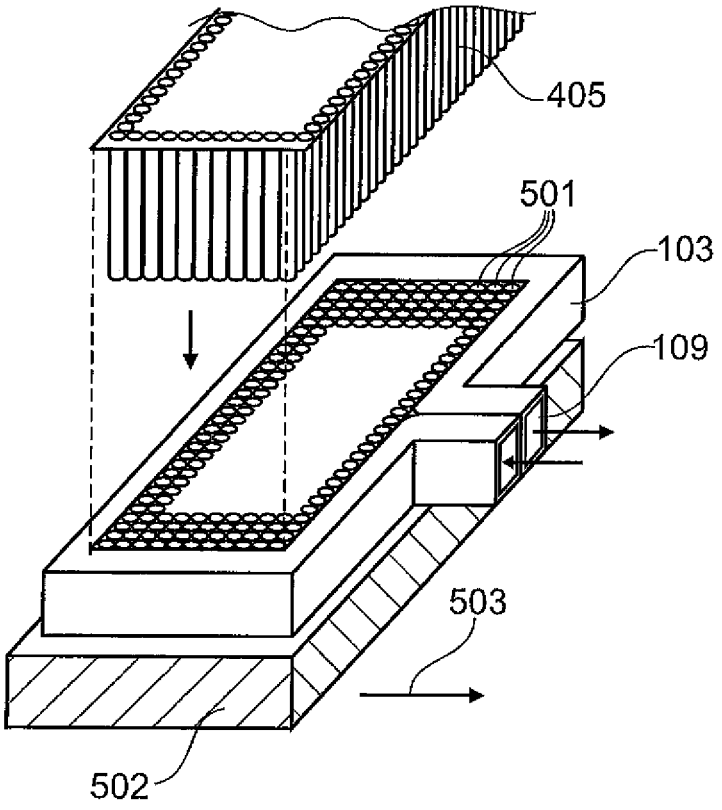

In the following, embodiment examples are described in more detail with reference to the appended drawings for a further explanation and a better understanding of the present invention. In the figures:

FIG. 1 is a schematic representation of an oven device having a belt element, according to an exemplary embodiment of the present invention, FIG. 2 is a schematic representation of a further oven device having a belt element, according to an exemplary embodiment of the present invention, FIG. 3 is a perspective representation of an oven device having an oven housing, according to an exemplary embodiment of the present invention, FIG. 4 is a schematic representation of an oven device having tempering pins, according to an exemplary embodiment of the present invention, and FIG. 5 is a schematic representation of an oven device having tempering pins and an insulation element, according to an exemplary embodiment of the present invention.

DETAILED DESCRIPTION OF EXEMPLARY EMBODIMENTS

Same or similar components in different figures are provided with the same reference numerals. The representations in the drawings are schematically.

FIG. 1 shows an oven device 100 for heat-treating a blank 101, in particular a metal blank. The oven device 100 may have an oven housing 102 having an oven chamber 113, in which the metal blank 101 may be heat-treatable with a defined temperature, and a tempering body 103, which may be arranged in the oven chamber 113, wherein the tempering body 103 may have a tempering surface 104.

Furthermore, the oven device 100 may have a tempering device 105, 405, wherein the tempering device 105, 405 may be arranged movably within the oven chamber 113 between a first position and a second position, such that the tempering device 105, 405 may be, at least in the first position, in thermal contact with the tempering body 103, and can, in the second position, be brought in thermal contact with the metal blank 101.

In an exemplary embodiment, the tempering device may be formed (or implemented) as a belt element 105 (see FIG. 1 and FIG. 2) and/or with a plurality of tempering pins (see FIG. 4 and FIG. 5).

According to the exemplary embodiment in FIG. 1, the oven device 100 may have a belt element 105 having a first section 106. The belt element 105 may be arranged within the oven chamber 113 movably between a first position and a second position, such that the first section 106, in the first position, may be in thermal contact with the tempering surface 104, and such that the first section 106, in the second position, can be brought in thermal contact with the metal blank 101.

The oven device 100 may be configured for heating the metal blank 101. The metal blank 101 may be heated up or cooled down in the oven device 100 to a desired temperature, e.g. to the austenitizing temperature. The austenitizing temperature may amount, for example, to from approximately 750° C. to approximately 1000° C., wherein the lower boundary of the austenitizing temperature may depend on the material of the metal component part (steel and alloy percentages).

The oven device 100 may have the oven chamber (see FIG. 1) or a plurality of different oven chambers. For example, a defined temperature can be adjusted in each oven chamber, such that the metal blank 101 may be exposed to a defined temperature for heating up or for cooling down in each of the oven chambers. The oven device 100 may, in particular, be configured such that a predetermined, temporally changeable temperature profile can be adjusted in the oven chamber. The temperature profile may act on (or may influence) the metal blank 101, while the latter may be present in the oven chamber of the oven housing 102 of the oven device.

In FIG. 1, the oven device may be configured, for example, according to the construction type of a continuous furnace (or through-type furnace), such that the metal blank 101 may be transported along a conveying direction 114 sequentially or continuously through the oven chamber and/or through plural oven chambers that may be arranged one after the other along the conveying direction 114.

Tempering elements 111, e.g. heating elements or cooling elements, can be arranged in the oven chamber, in order to possibly adjust a desired temperature profile in the oven chamber, such that the metal blank 101 may be selectively heated up, cooled down or kept at a constant temperature. The temperature in the oven chamber of the oven device 100 can be adjusted, for example, between approximately 100° C. up to approximately 1000° C.

In order to selectively adjust different ductile regions of a metal blank 101, specific regions of the metal blank may be selectively heated up temporally differently and may in particular be cooled down temporally differently, in order to thereby possibly adjust different microstructure regions in the different regions of the metal blank 101.

In particular, pre-determined regions of the metal blank 101 can be cooled down in the oven device 100, by bringing a first section 101 of the band element 105 in thermal contact with a pre-determined surface region of the metal blank 101, which is to be cooled down. In the embodiment example in FIG. 1, the second section 107 may lie on the metal blank 101.

The tempering body 103 may have, in particular, a high heat storage capacity, such that the latter can perform plural cooling cycles of the first section 106 or of a second section 107 of the belt element.

The belt element 105 may consist of a flexible and/or deformable material, and may be arranged movably between the first position and the second position by a drive device 201 (see FIG. 2). The belt element 105 may be formed, for example, from a metal sheet-type belt. The belt element 105 may further consist of a ring webbing, in particular of a metallic ring webbing.

The belt element 105 further may have a second section 107, which may be spaced apart from the first section 106. The second section 107 may be configured e.g. such that, in the second position, the second section 107 can be arranged spaced apart from the metal blank 101. In particular, the second section 107 may be configured such that, in the second position, the second section 107 may be in thermal contact with the tempering surface 104 of the tempering body 103 and/or may lie on the tempering surface 104.

While, in the second position, the first section 106, for example, may cool a metal blank 101, the second section 107 may be cooled by the tempering body 103 and vice versa. In a following production step, the belt element 105 may then be moved from the second position to the first position, such that the first section 106 may be tempered (or temperature-controlled) by the tempering body 103 and the second section 107 may temper the metal blank 101 or a further metal blank.

Accordingly, the belt element 105 may comprise further, third sections, which may be arranged between the first section 106 and the second section 107, and which may be, in a third position of the belt element 105, in thermal contact either with the tempering surface 104 of the tempering body 103 and/or with a metal blank 101.

The first section 106 (and/or the second section 107) of the belt element 105 can be moved to the first position after cooling the metal blank 101, in which first position the first section 106 may be in thermal contact with the tempering surface 104 of the tempering body 103. This may mean that in the first position of the first section 106, the latter e.g. may lie on the tempering surface 104. In the first position, the first section 106 of the belt element 105 may thus be pre-cooled, and may subsequently be moved to (or in) the second position in which the first section 106 may be in thermal contact with the metal blank 101, in order to possibly quench the latter. Subsequently, the first section 106 may be moved anew to the first position for a pre-cooling.

Thus, a defined region of the metal blank 101 or the whole metal blank 101 can be cooled down or alternatively heated up effectively with (or by) the first section 106 (and/or the second section 107) of the belt element 105. At the same time, the first section 106 can be cooled down multiple times by the tempering body 103 in order to possibly temper a plurality of metal blanks 101 and/or regions of metal blanks 101, without a high constructive effort or a time-costly changeover of the oven device 100 being necessary.

The tempering body 103 in FIG. 1 may have a tempering device 108, i.e. a cooling device or a heating device. The tempering device 108 may temper, i.e. may cool or may heat, the tempering body 103, such that accordingly that section 106, 107 of the belt element 105, which may not be in thermal contact with the tempering surface 104, may be tempered with a desired temperature. After the tempering, the corresponding section 106, 107 may be brought in thermal contact with the metal blank 101, and thus the latter may be tempered.

The tempering device 108 may have a pipe 109, which may extend within the tempering body 103. The medium for tempering the tempering body can be introduced in (or fed into) the pipe 109 (in particular from the exterior of the oven housing 102). The medium for tempering may be in particular gaseous or liquid. For example, the medium may be a cooling agent and/or a cooling liquid for cooling the tempering device 108. Thus, a liquid cooling of the tempering body 103 can be realized, such that those sections 106, 107 of the belt element 105, which may be in thermal contact with the tempering surface 104, may be cooled permanently in order to possibly subsequently temper anew the metal blank 101. In a preferred embodiment, in other words, the tempering body 103 may be a cooling body, which may have a temperature that may be significantly cooler than the temperature in the oven chamber, in particular less than half of the temperature in the oven chamber.

In the embodiment example in FIG. 1, the belt element 105 may form a belt loop, which may surround the tempering body 105. In the second position, the first section 106 may be spaced apart from the tempering body 103. In the first position, the second section 107 may be spaced apart from the tempering body 103. The belt element 105 may be arranged such that, in the second position, the first section 106 can be arranged between the tempering body 103 and the metal blank 101, and the first section 106 may be spaced from the tempering body 103.

In the embodiment example in FIG. 1, the belt element 105 may be formed such that it can be laid on the metal blank 101, such that, upon movement of the metal blank 101, a movement of the belt element 105 relative to the tempering body 103 may be generatable. By laying the belt element 105 on the metal blank 101, a friction force may be generated between the belt element 105 and the metal blank 101. If the metal blank 101 is moved along the conveying direction 114, the metal blank 101 may take with it the belt element 105 during its movement due to the friction force, such that the belt element 105 may move and can be moved from the first position to the second position and vice versa. For one and the same movement direction of the belt element 105, the first section 106 and the second section 107 may be laid alternatingly on different regions of the metal blank 101 or on metal blanks 101 that may be arranged one after the other along the conveying direction 114.

Furthermore, an insulation housing 110 may be arranged in the oven chamber. The insulation housing 110 may surround at least partially the tempering body 103 and the belt element 105, such that the insulation housing 110 may screen thermally the tempering body 103 and the belt element 105 from a region of the oven chamber, which region may surround the insulation housing 110. The insulation housing 110 may, for example, have a cap shape and can be put over the tempering body 103, wherein the insulation housing 110 may have an opening in the direction towards the metal blank 101, such that the belt element 105 can be brought in contact with the metal blank 101 with one section 106, 107. For example, the region of the oven chamber, which may surround the insulation housing 110, may have a high temperature and may thus be used for heating the metal blank 101. Within the insulation housing 110, lower temperatures may then prevail, because the insulation housing 110 may insulate thermally the interior space of the insulation housing 110 from the surroundings of the insulation housing 110. Thus, a tempering of the metal blank 101 by the belt element 105 can be performed more efficiently, because lower thermal influences from other regions of the oven chamber may have a disturbing influence.

The oven device 100 further may have a conveying device 112 for conveying the metal blank 101 within the oven chamber along the conveying direction 114. The conveying device 112 may have, for example, a plurality of conveying rollers, which can be driven. A metal blank 101 that may be arranged on the conveying rollers can be conveyed through the oven chamber along a conveying direction 114 by rotating the conveying rollers.

Instead of the belt element 105 as the tempering device, also the plurality of tempering pins 405 together with a corresponding implementation of the tempering body 103 may be used in the oven device 100 from FIG. 1.

FIG. 2 shows an oven device 100 according to a further exemplary embodiment. In addition or alternatively to the features of the oven device 100 of FIG. 1, the oven device 100 of FIG. 2 may have a drive device 201. The drive device 201 may be configured to move the belt element 105 between the first position and the second position. The drive device 201 may have one or plural driving rollers 202, which may move the belt element 105 between the first position and the second position.

The belt element 105 as a belt loop may extend, for example, over one or plural driving rollers 201, wherein at least one driving roller may be driven and thus may drive the belt element in order to possibly move the sections 106, 107 back and forth between the first position and the second position. The belt element 105 as a belt loop may be arranged, for example, loosely over one driving roller 202, or pre-stressed around a driving roller 202. The belt element 105 may, for example, be driven according to the type of a belt drive. Thus, the belt element 105 may have, for example, tooth elements of the type of a toothed belt, which tooth elements may engage in corresponding tooth elements of a driving roller 202 in order to thus possibly drive the belt element 105. In other words, a V-belt (or fan belt) drive and/or a toothed belt drive can be enabled. Alternatively, for a pre-stress of the belt element 105 around the driving roller 202, a flat belt drive can be enabled.

FIG. 3 shows a perspective representation of an oven device 100 of FIG. 1 or FIG. 2. In the oven device 100 of FIG. 3, it is shown demonstratively, that even plural tempering bodies 103, 103' can be arranged e.g. along the conveying direction 114. One belt element 105 may, for example, extend around each tempering body 103, 103', respectively. Furthermore, a belt element 105 may also extend around plural tempering bodies 103, 103'.

Furthermore, the tempering bodies 103, 103' can be arranged exchangeably in the oven housing 102 and/or may be provided with a cooling or heating device (i.e. by the tempering device 108).

The tempering bodies 103, 103' may thus be substituted (or replaced) after tempering the first section 106 and/or the second section 107 and/or after a specific number of tempering cycles for maintenance or for their own tempering.

The tempering bodies 103, 103' may, for example, be formed as passive tempering bodies 103, 103'. This may mean that the tempering bodies 103, 103' may have a high heat storage capacity, and may not actively be tempered during the arrangement in the oven chamber. This may mean that the tempering bodies 103, 103' may heat up and/or may cool down themselves after plural (cycles of) heating up and/or cooling down of the corresponding sections 106 and 107 of the belt element 105. After a pre-defined boundary temperature of the respective tempering body 103, 103' may be reached, the latter can be substituted and can, for example, be replaced by another, pre-tempered tempering body 103, 103'. Thus, the oven device 100 may be able to still temper corresponding metal blanks 101 without long changeover times.

FIG. 4 and FIG. 5 show further exemplary embodiments of the oven device 100 for heat-treating the blank 101. The oven device 100 may have the oven housing 102 having the oven chamber 113, in which the metal blank 101 may be heat-treatable with a defined temperature, and the tempering body 103, which may be arranged in the oven chamber 113. Furthermore, the oven device 100 may have a number of tempering pins 405. Accordingly, the tempering body 103 may have a plurality of receiving boreholes 501 (see FIG. 5), in each of which one of the tempering pins 405 can be introduced. The plurality of tempering pins 405 may be arranged movably between the first position and a second position, such that the plurality of tempering pins 405 may be, in the first position, in thermal contact with the tempering body 103, and can, in the second position, be brought in thermal contact with the blank 101.

The tempering body 103 can be moved together with the tempering pins 405 relative to the blank 101. Alternatively, the plurality of tempering pins 405 can move relative to the tempering body 103 and the blank 101 (see the embodiment example in FIG. 5). The tempering pins 405 may be guided in the receiving boreholes 501 of the tempering body 103. The tempering pins 405 may be thermally coupled to the tempering body 501, and can thus be heated or correspondingly cooled.

The tempering pins 405 may be arranged slidably in the respective receiving boreholes 501, such that the tempering pins 405 can, in the second position, be laid on a surface of the blank 101 and can be fitted to a contour of the surface of the blank 101.

In the second position, the tempering pins 405 may lie directly on the surface of the blank 101. Upheavals of the contour of the surface of the blank 101 may shift the corresponding tempering pins 405 in the direction towards the tempering body 103, and recesses in the contour of the surface of the blank 101 may shift the corresponding tempering pins 405 away from the tempering body 103. Thus, even for an uneven (or non-planar) implementation of the blank 101 (see FIG. 4), the tempering pins 405 can lie on the surface of the blank 101.

The tempering pins 405 and/or the tempering body 103 can be moved towards the blank 101, or depart from the latter, along a lifting direction 402 by a drive device 401. The drive device 401 may have, for example, a lifting device that is driven pneumatically or hydraulically.

As is represented in FIG. 5, the tempering body 103 may have a central region having the plurality of receiving boreholes 501. The central region may be cooled, for example by an integrated pipe 109, which may extend around the central region and through which a cooling medium may flow. Thus, the central region of the tempering body 103 may be kept at a desired temperature.

As is further represented in FIG. 5, the oven device 100 may have an insulation element 502 (insulation block), which can be introduced selectively between the tempering body 103 and the blank 101. In particular, the insulation element 502 can, in the first position of the tempering device 105, 405 be present, between the tempering body 103 and the blank 101. Thus, the tempering device 105, 405 can be brought to a desired temperature by the tempering body 103 more effectively, because the tempering body 103 may be insulated by the insulating element 502 from the thermal influence of the blank 101 and the surrounding oven chamber 113. The insulation element 502 may be introduced, for example, by a further conveying device selectively between the tempering body 103 and the tempering device 105, 405 on the one hand and the blank 101 on the other hand, and can be moved, for example, along a movement direction 503. The movement direction 503 may be configured, for example, orthogonally to the conveying direction 114 of the blank 101 in the oven device 100.

Supplementarily, it is noted that "having" (or "comprising") does not exclude other elements or steps, and "a" or "an" does not exclude a plurality. Furthermore, it is noted that features or steps, which have been described with reference to one of the embodiment examples above, can be used also in combination with other features or steps of other embodiment examples that are described above. Reference numerals in the claims are not to be considered as limitations.

LIST OF REFERENCE NUMERALS

100 oven device
101 metal blank
102 oven housing
103 tempering body
104 tempering surface

105 belt element
106 first section
107 second section
108 tempering device
109 pipe
110 insulation housing
111 tempering elements
112 conveying device
113 oven chamber
114 conveying direction
201 drive device
202 driving roller
401 drive device
402 drive direction
405 tempering pin
501 receiving borehole
502 insulating element
503 movement direction of insulating element

The invention claimed is:

1. Oven device for heat-treating a metal blank, the oven device having:

an oven housing having an oven chamber, in which the metal blank is heat-treatable with a defined temperature, a tempering body, which is arranged in the oven chamber, wherein the tempering body has a tempering surface, a tempering device, wherein the tempering device is arranged within the oven chamber movably with respect to the tempering body between a first position and a second position, such that a tempering section of the tempering device is in thermal contact with the tempering body and spaced apart from the metal blank at least in the first position for being tempered by the tempering body via the tempering surface and the tempering section can be brought spaced apart from the tempering body in direct contact and in thermal contact with the metal blank in the second position for tempering the metal blank wherein pre-defined regions of the metal blank can be cooled or heated up by the thermal contact between the tempering section and a pre-defined surface region of the pre-defined regions of the metal blank, wherein the tempering device has a plurality of tempering pins, wherein the tempering body has a plurality of receiving boreholes, into each of which one of the tempering pins can be introduced, respectively, wherein the plurality of tempering pins is arranged movably between the first position and a second position, such that the plurality of tempering pins is, in the first position, in thermal contact with the tempering body and can, in the second position, be brought in thermal contact with the blank; and a drive device, wherein the drive device is configured to move the tempering device between the first position and the second position.

2. Oven device according to claim 1, wherein the tempering device is formed as a belt element, wherein the belt element has a first section, wherein the belt element is arranged within the oven chamber movably between the first position and the second position, such that the first section is in thermal contact with the tempering surface in the first position and that the first section can be brought in thermal contact with the blank in the second position, wherein the belt element further has a second section, which is spaced apart from the first section, and wherein the second section is formed such that in the second position the second section can be arranged spaced apart from the blank.

3. Oven device according to claim 2, wherein the belt element forms a belt loop, which surrounds the tempering body, wherein the belt element is arranged such that, in the second position, the first section can be arranged between the tempering body and the blank.

4. Oven device according to claim 2, wherein, in the second position, the first section is spaced apart from the tempering body.

5. Oven device according to claim 1, wherein the second section is formed such that, in the second position, the second section is in thermal contact with the tempering surface of the tempering body.

6. Oven device according to claim 2, wherein the belt element is configured such that it can be laid on the blank, such that, upon movement of the blank, a movement of the belt element relative to the tempering body is generatable.

7. Oven device according to claim 2, wherein the belt element has a ring webbing.

8. Oven device according to claim 1, wherein the tempering pins are arranged slidably in the respective receiving, such that the tempering pins, in the second position, can be laid on a surface of the blank and can be fitted to a contour of the surface of the blank.

9. Oven device according to claim 1, wherein the tempering body is arranged exchangeably in the oven chamber.

10. Oven device according to claim 1, wherein the tempering body is arranged movably in the direction towards the blank.

11. Oven device according to claim 1, wherein the tempering device is a temperature control device.

12. Oven device according to claim 11, wherein the tempering control device has a pipe, which extends within the tempering body, wherein a medium for tempering the tempering body can be fed into the pipe.

13. Oven device according to claim 1, further having an insulation housing, which is arranged in the oven chamber, wherein the insulation housing surrounds the tempering body at least partially, such that insulation housing screens thermally the tempering body from a region of the oven chamber, which surrounds the insulation housing.

14. Oven device according to claim 1, further having an insulation element, which can be introduced selectively between the tempering body and the blank.

15. Oven device according to claim 1, further having a conveying device for conveying the blank within the oven chamber.

16. Oven device for heat-treating a metal blank, the oven device having:

an oven housing having an oven chamber, in which the metal blank is heat-treatable with a defined temperature, a tempering body, which is arranged in the oven chamber, wherein the tempering body has a tempering surface, wherein the tempering body is arranged movably in the direction towards the metal blank, a tempering device, wherein the tempering device is arranged within the oven chamber movably with respect to the tempering body between a first position and a second position, such that a tempering section of the tempering device is in thermal contact with the tempering body and spaced apart from the metal blank at least in the first position for being tempered by the tempering body via the tempering surface and the tempering section can be brought spaced apart from the tempering body in direct contact and in thermal contact with the metal blank in the second position for tempering the metal blank wherein pre-defined regions of the metal blank can be cooled or heated up by the thermal contact between the tempering section and a pre-defined surface region of the pre-defined regions of the metal blank, and a drive device, wherein the drive device is configured to move the tempering device between the first position and the second position.

17. Oven device for heat-treating a metal blank, the oven device having:

an oven housing having an oven chamber, in which the metal blank is heat-treatable with a defined temperature, a tempering body, which is arranged in the oven chamber, wherein the tempering body has a tempering surface, a tempering device, wherein the tempering device is arranged within the oven chamber movably with respect to the tempering body between a first position and a second position, such that a tempering section of the tempering device is in thermal contact with the tempering body and spaced apart from the metal blank at least in the first position for being tempered by the tempering body via the tempering surface and the tempering section can be brought spaced apart from the tempering body in direct contact and in thermal contact with the metal blank in the second position for tempering the metal blank wherein pre-defined regions of the metal blank can be cooled or heated up by the thermal contact between the tempering section and a pre-defined surface region of the pre-defined regions of the metal blank, a drive device, wherein the drive device is configured to move the tempering device between the first position and the second position, and an insulation element, which can be introduced selectively between the tempering body and the metal blank.

* * * * *